US011274383B2

(12) United States Patent
Jesch et al.

(10) Patent No.: US 11,274,383 B2
(45) Date of Patent: Mar. 15, 2022

(54) ENGINEERED KNIT WITH MULTI-DENSITY KNIT ZONE

(71) Applicant: TBL Licensing LLC, Stratham, NH (US)

(72) Inventors: Susanne Annette Jesch, Arvada, CO (US); Anne Louise Wiper, Boulder, CO (US)

(73) Assignee: TBL Licensing LLC, Stratham, NH (US)

( * ) Notice: Subject to any disclaimer, the term of this patent is extended or adjusted under 35 U.S.C. 154(b) by 248 days.

(21) Appl. No.: 16/396,894

(22) Filed: Apr. 29, 2019

(65) Prior Publication Data

US 2019/0335822 A1 Nov. 7, 2019

Related U.S. Application Data

(60) Provisional application No. 62/665,205, filed on May 1, 2018.

(51) Int. Cl.
*D04B 1/24* (2006.01)
*A41D 1/04* (2006.01)
(Continued)

(52) U.S. Cl.
CPC ..... *D04B 1/24* (2013.01); *A41D 1/04* (2013.01); *D04B 21/10* (2013.01); *D04B 21/207* (2013.01);
(Continued)

(58) Field of Classification Search
CPC ..... D04B 1/24; D04B 1/22; D04B 21/207; D04B 21/10; D04B 1/246; D04B 1/243;
(Continued)

(56) References Cited

U.S. PATENT DOCUMENTS 6,782,590 B2 * 8/2004 Rock ..... A41D 31/102 28/105
7,428,772 B2 * 9/2008 Rock ..... A41D 13/002 28/159
(Continued)

FOREIGN PATENT DOCUMENTS

| | | | |
|---|---|---|---|
| EP | 1813159 | A1 | 8/2007 |
| WO | 2006002371 | A2 | 1/2006 |
| WO | 2010035164 | A1 | 4/2010 |

OTHER PUBLICATIONS

Extended European Search Report including the Written Opinion for Application No. EP 19171797.4 dated Oct. 23, 2019, 9 pages.
(Continued)

*Primary Examiner* — Danny Worrell
(74) *Attorney, Agent, or Firm* — Lerner, David, Littenberg, Krumholz & Mentlik, LLP

(57) ABSTRACT

A knitted element may include at least three zones. The first zone may include terry loop knitting. The second zone may include mesh knitting. The third zone may include jersey knitting. The knitted element may include at least one seamless transition between the first zone and the second zone, or between the first zone and the third zone so that terry loop knitting is continuous with either the mesh knitting or the jersey knitting. The first zone, the second zone, and the third zone may each include wool knitting. The terry loop knitting may be adapted to provide warmth in areas where it is needed, while the mesh knitting may be adapted to provide breathability in areas where it is needed. The jersey knitting may provide an intermediate level of warmth and breathability.

14 Claims, 11 Drawing Sheets

(51) Int. Cl.
*D04B 21/10* (2006.01)
*D04B 21/20* (2006.01)

(52) U.S. Cl.
CPC ..... *A41D 2500/10* (2013.01); *D10B 2501/04* (2013.01)

(58) Field of Classification Search
CPC ..... D04B 1/104; D04B 1/102; A41D 1/04; A41D 27/28; D10B 2501/04; D10B 2500/10
See application file for complete search history.

(56) References Cited

U.S. PATENT DOCUMENTS 7,579,045 B2 * 8/2009 Rock ..... D04B 1/24 427/288
7,743,476 B2 * 6/2010 Rock ..... D04B 1/04 28/160
8,250,676 B2 8/2012 Ramsey et al.
10,130,129 B2 * 11/2018 Rock ..... A41D 31/065
10,231,494 B2 * 3/2019 Shapiro ..... A41D 13/002
2002/0122914 A1 * 9/2002 Rock ..... A41D 13/00 428/85
2005/0061802 A1 * 3/2005 Rock ..... D02G 3/441 219/545
2012/0260422 A1 * 10/2012 Rock ..... A47G 9/0223 5/483
2013/0133127 A1 5/2013 Ramsey et al.

OTHER PUBLICATIONS

"Workbook Winter 2015/16", Ortavox, Nov. 18, 2014 (Nov. 18, 2014), p. 57,58,64,108, XP055629249, Retrieved from the Internet: URL:https://issuu.com/ortovox/docs/workbook 2015-16 de [retrieved on Oct. 7, 2019].

* cited by examiner

LEGEND

- PLACEMENT 1-CUSHIONING (EXTERIOR)
- PLACEMENT 2-CUSHIONING (INTERIOR)
- PLACEMENT 3-MESH
- PLACEMENT 4-JERSEY
- PLACEMENT 5-2X1 ARTICULATED RIB
- PLACEMENT 6-2X1 RIB

ENGINEERED KNIT WITH MULTI-DENSITY KNIT ZONE

CROSS-REFERENCE TO PREVIOUSLY FILED APPLICATIONS

This application claims the benefit of the filing date of U.S. Provisional Patent Application No. 62/665,205, filed May 1, 2018, the disclosure of which is hereby incorporated by reference herein.

BACKGROUND OF THE DISCLOSURE

Knitted clothing is typically made in three forms, including (i) from knit yardage that is then cut and sewn in panels together, (ii) flat bed knitting where the panels are shaped to the garment, and panels are then linked or joined together, or (iii) seamless knitting, where panels are executed in a tube and then the sleeves and collars, in the case of top layers, are then sewn on. To explain further, in the cut and sewn method of using knit yardage, it may be desirable to include different types of knitting stitches in the same knitted garment, or otherwise in the same knitted fabric that forms a part of a garment. Generally, in this method, knitted fabrics contain different types of knitting stitches, and each type of knitting stitch may be created on an individual panel, with the panels later being joined together in order to create the fabric having the various types of knitting stitches. However, it may be desirable to produce a knitted garment, or a knitted fabric that may form part of a garment, as a seamless construction or flat bed knitting construction in which two or more types of knitting stitches are present without requiring each type of knitting stitch to be first formed on a separate panel, with the panels later being joined together.

BRIEF SUMMARY

According to an embodiment of the disclosure, a knitted element may include at least three zones. The first zone may include terry loop knitting. The second zone may include mesh knitting. The third zone may include jersey knitting. The knitted element may include at least one seamless transition between the first zone and the second zone, or between the first zone and the third zone so that terry loop knitting is continuous with either the mesh knitting or the jersey knitting. The first zone, the second zone, and the third zone may each include wool knitting. The wool knitting may include wool wrapped around a nylon core or just 100% wool yarn. A fourth zone may include mesh knitting, and the mesh knitting of the second zone may define openings that are larger than openings defined by the mesh knitting of the fourth zone. The terry loop knitting of the first zone may include full terry looping such that each stitch in the first zone includes terry looping. The terry loop knitting of the first zone may include a stitch pattern that alternates between terry looping and jersey knits. The knitted element may include a first seamless transition between the first zone and the second zone, and a second seamless transition between the first zone and the third zone, so that the knitted element includes terry loop knitting that is continuous with both the mesh knitting and the jersey knitting. The knitted element may form part of a garment. The knitted element may be a sleeve of a top, and the second zone of the sleeve may be positioned adjacent to an interior elbow area of the sleeve and/or an armpit area of the sleeve. The knitted element may be a front torso of a top, and the first zone may be positioned adjacent to a shoulder area and/or a chest area of the front torso. A plurality of the knitted elements may form a garment, wherein the plurality of knitted elements includes a sleeve element, a front torso element, and a back torso element.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
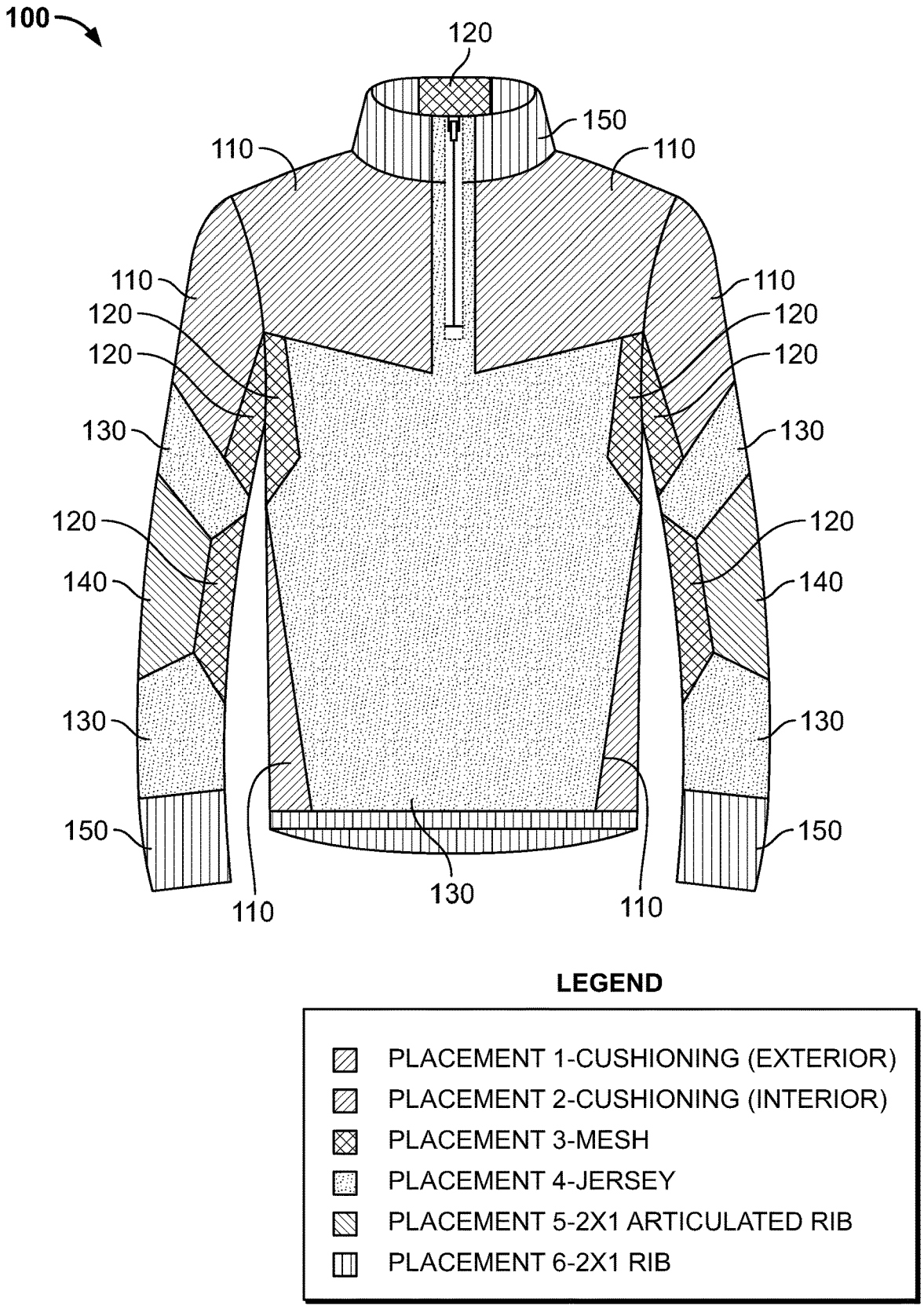
FIG. 1A is a schematic illustration of a front portion of a garment according to an aspect of the disclosure.
Figure 1B:
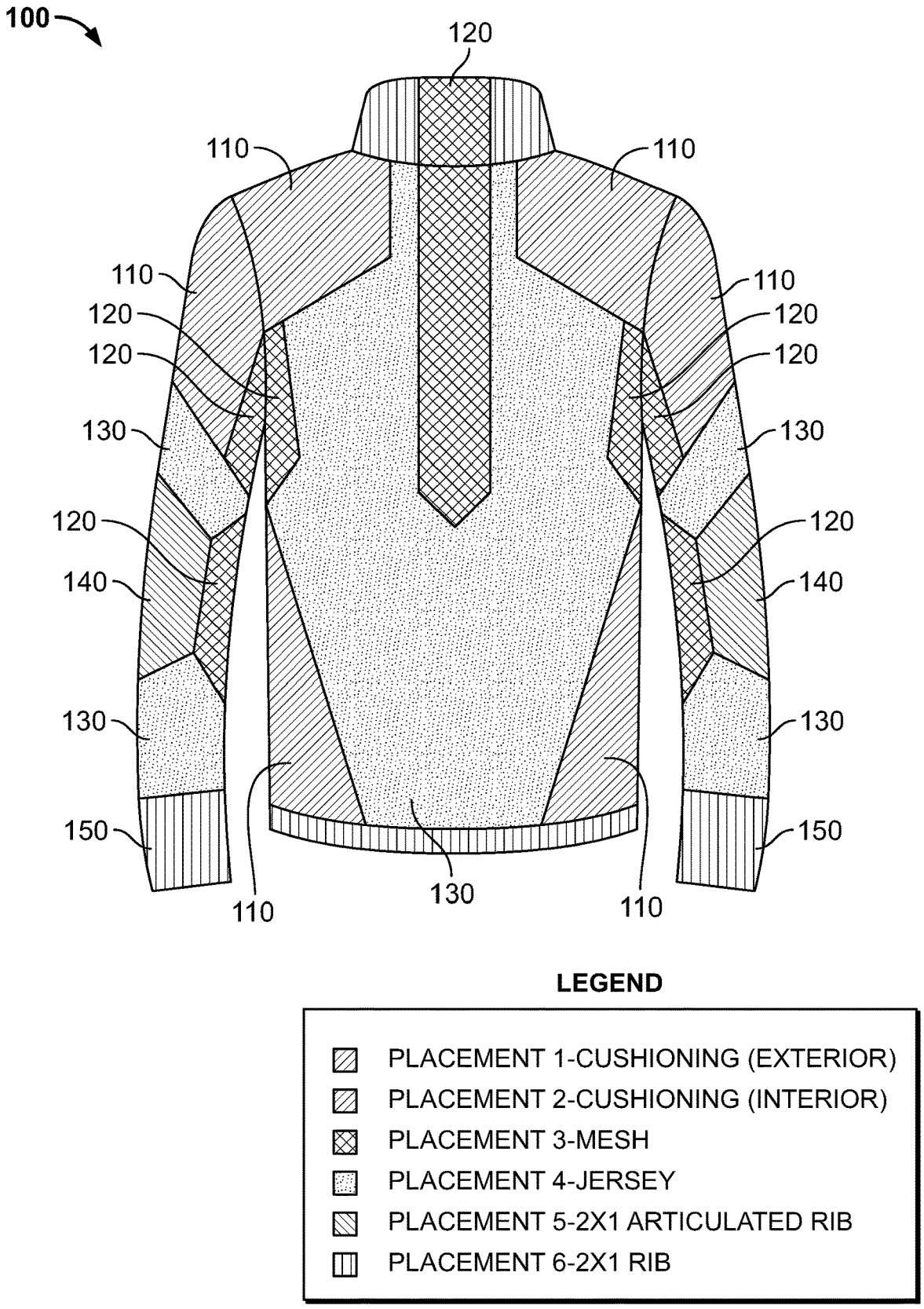
FIG. 1B is a schematic illustration of a back portion of the garment of FIG. 1A.

FIGS. 1A-B illustrate front and rear views, respectively, of a garment 100 according to an aspect of the disclosure. In this particular example, garment 100 is in the form of a knitted base layer top or shirt. Garment 100 may include a plurality of different zones to provide desired functionality in each zone. For example, various different zones of garment 100 may provide for different layers of warmth or ventilation, and such zones may be based on gender-specific body maps of temperature and perspiration, and/or user perceived needs of warmth and ventilation. Garment 100 includes at least three types of zones that may assist in providing a desired level of warmth and/or ventilation in the particular zones, although as will be described in greater detail below, additional zones may be included. Although garment 100 may be worn by any individual, the particular location of the various zones described below may be specific to male body-mapping in order to provide the desired levels of warmth and ventilation for relevant areas of male bodies.

Three of the zones illustrated in FIGS. 1A-B include cushioning zones 110, mesh zones 120, and jersey zones 130. Cushioning zones 110, which may also be referred to herein as terry zones or terry loop zones, include terry loop knitting which provides a greater level of warmth to the wearer than the mesh zones 120 and jersey zones 130. Terry loop may also be understood as a loop stitch that can be patterned to every knit stitch, or in any other desired pattern. Cushioning zones 110 may be provided so that, when garment 100 is worn, the cushioning zones are positioned adjacent areas of the body expected to lose a relatively large amount of heat, or otherwise adjacent areas of the body that a user perceives to need additional warmth. Mesh zones 120, on the other hand, may include mesh knitting which provides large holes or openings relative to the cushioning zones 110 and the jersey zones 130. Mesh knit may also be understood as a transfer stitch that creates an eyelet to an otherwise flat knit section. The relatively large openings in mesh zones 120 may provide for more ventilation than either of the cushioning zones 110 and jersey zones 130. Mesh zones 120 may be provided so that, when garment 100 is worn, the mesh zones are positioned adjacent areas of the body expected to perspire more than other areas of the body, or otherwise adjacent areas of the body that a user perceive to need additional ventilation. Jersey zones 130 may include jersey knitting, and the jersey zones may be thought of as intermediate zones in that they typically provide a level of warmth greater than mesh zones 120 but less than cushioning zones 110, and a level of ventilation greater than the cushioning zones but less than the mesh zones. Jersey knitting may also be understood as flat knitting, for example where every stitch is a knit stitch. The jersey zones 130 may be provided so that, when garment 100 is worn, the jersey zones are positioned adjacent body parts that require (or are perceived by the wearer to require) relatively little ventilation and warmth.

Figure 1C:
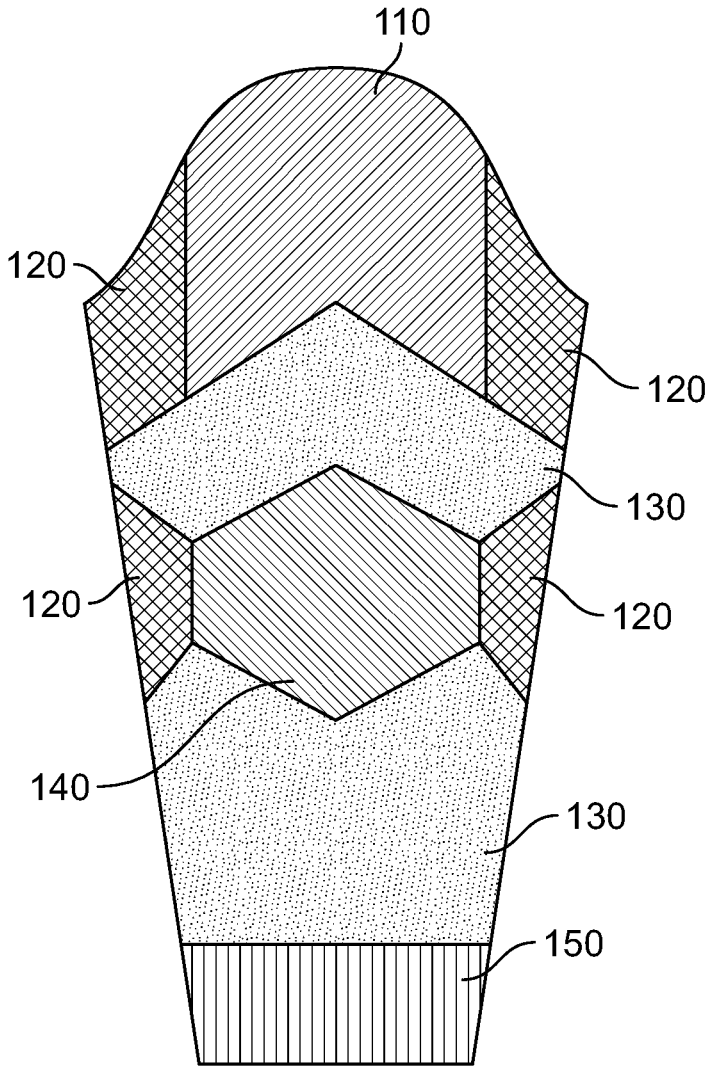
FIG. 1C is a flat schematic view of a sleeve of the garment of FIG. 1A.

In the illustrated embodiment, garment 100 may be produced in multiple individual pieces that are coupled together. For example, each sleeve of garment 100 may be knitted as a flat element, as shown in FIG. 1C, with the appropriate edges of the sleeve sewn or otherwise coupled together to provide the desired finished shape. Similarly, the front and the back of the torso portion of garment 100 may each be knitted as flat elements, with the front and the back of the torso portions coupled together along their edges, and the sleeves coupled to the torso portions to produce the final product. This type of method may generally be referred to as flat bed knitting, although the concepts described herein may be applied to knitting methods in which portions of garment 100 are not created as flat pieces initially, but rather are created to initially include the desired three-dimensional shape, such as a method which produces a sleeve in a tubular shape. In either case, the individual portions of garment 100 are still considered seamless, as the term as used herein generally refers to the transitions between the various zones described above within a particular element of garment 100. For example, referring to FIG. 1C, a sleeve of garment 100 produced as a flat element is illustrated as having a cushioning zone 110 near the shoulder, mesh zones 120 near the armpit and interior elbow, and jersey zones 130 near the triceps and forearms. In addition, the exterior elbow portion of the sleeve is illustrated as having an articulated rib zone 140 having a 2×1 rib knit, and the wrist or cuff portion of the sleeve is illustrated as having a ribbed zone 150 having a 2×1 rib knit. Generally, the articulated rib knit of articulated rib zone 140 may provide the ability the three-dimensionally shape to the elbow by using shaping, for example either adding stitches to the section of rib knit or removing stitches from the rib knit to create a three-dimensional shape within the same specifications for achieving the desired elbow dimensions. The cushioning zone 110, mesh zones 120, and jersey zones 130 may transition seamlessly between one another, eliminating the requirement to produce a separate panel including terry loops for the cushioning zone 110, and then coupling that separate panel to panels having the mesh knitting of mesh zones 120 and/or the jersey knitting of jersey zones 130. The seamless transition between the cushioning zone 110 and the mesh zone 120, and the seamless transition between the cushioning zone 110 and the jersey zone 130 are of particular difficulty, as the terry loops within cushioning zone 110 are prone to pulling out under stress, such as when garment 100 is worn. In order to prevent the terry loops of cushioning zone 110 from pulling out, the terry loops may be knitted on the back side (or interior) of the garment or garment element and the terry loop may be secured to the ground or face yarn of the garment, therefore securing the loop to the interior to prevent it from pulling out. Benefits of this type of garment, for example having seamless transitions between the three zones described above, may include more mobility being naturally built into the garment and providing a more comfortable fit to the wearer. For example, seams in certain areas of the garment that may otherwise restrict movement for the end user can be avoided. The elimination of these particular seams may also provide a better fit overall, as the garment (or otherwise elements of the garment) is completely knit to fit the body without having to ease in different panels of fabric into seams, which otherwise may create a more time consuming and potentially worse-fitting garment. There may also be significantly less waste in garment 100 than a traditional cut-and-sew garment, as garment 100 can effectively be "sculpted" to the exact desired specification when being knit (for example on a knitting machine), which is difficult or impossible to achieve using cut-and-sew methods. In addition, the provision of the three zones described above provides an extra layer of warmth that has not previously been provided in the configurations described herein. It should be understood that these benefits may apply to each embodiment described herein. It should be understood that the seamless transitions between the zones described above may apply to any element of any of the garments described herein.

It should be understood that FIGS. 1A-C include a legend to help identify the various zones described above. However, FIGS. 1A-C only illustrate the exterior of garment 100, so it should be understood that the legend reference to the interior cushioning does not correspond to any zone illustrated in FIGS. 1A-C.

Garment 100, and the various knitting zones described above, may be formed of any desired fiber. However, it may be preferable to form the garment of wool, and in particular merino wool, as merino wool has one or more desirable properties including being lightweight, breathable, good moisture management, antibacterial and odor resistant, while being an organic and renewable fiber. However, it should be understood that other fibers or elements may be included, for example the wool may be wrapped around a nylon core that provides for added durability with the wool substantially surrounding the nylon core. The same is true of other garments described herein.

Referring again to FIGS. 1A-B, it should be understood that even if seams exist in garment 100 to couple, for example, one edge of each sleeve to another edge of each sleeve, the front torso to the rear torso, and the tubular sleeves to the torso, each individual element is itself seamless. In other words, each sleeve of garment 100 includes seamless transitions between a cushioning zone 110 and a mesh zone 120 and/or a jersey zone 130. Similarly, the front torso and back torso elements each include seamless transitions between at least one cushioning zone 110 and a mesh zone 120 and/or jersey zone 130. Although each individual element of garment 100 in other embodiments needs not have every single element include such seamless transitions zones, the garment illustrated in FIGS. 1A-B does include seamless zones in each element.

Figure 2A:
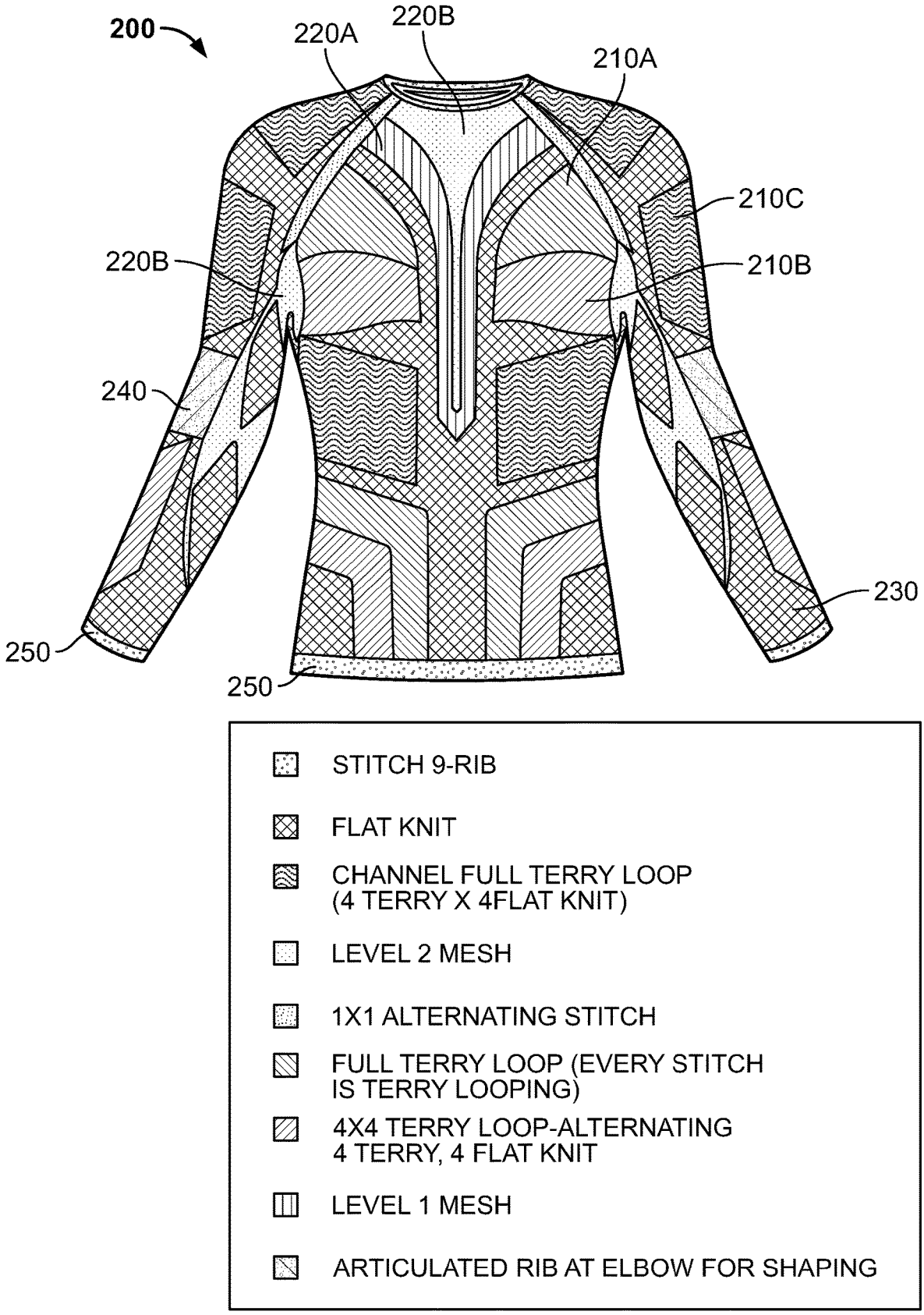
FIG. 2A is a schematic illustration of a front portion of a garment according to another aspect of the disclosure.
Figure 2B:
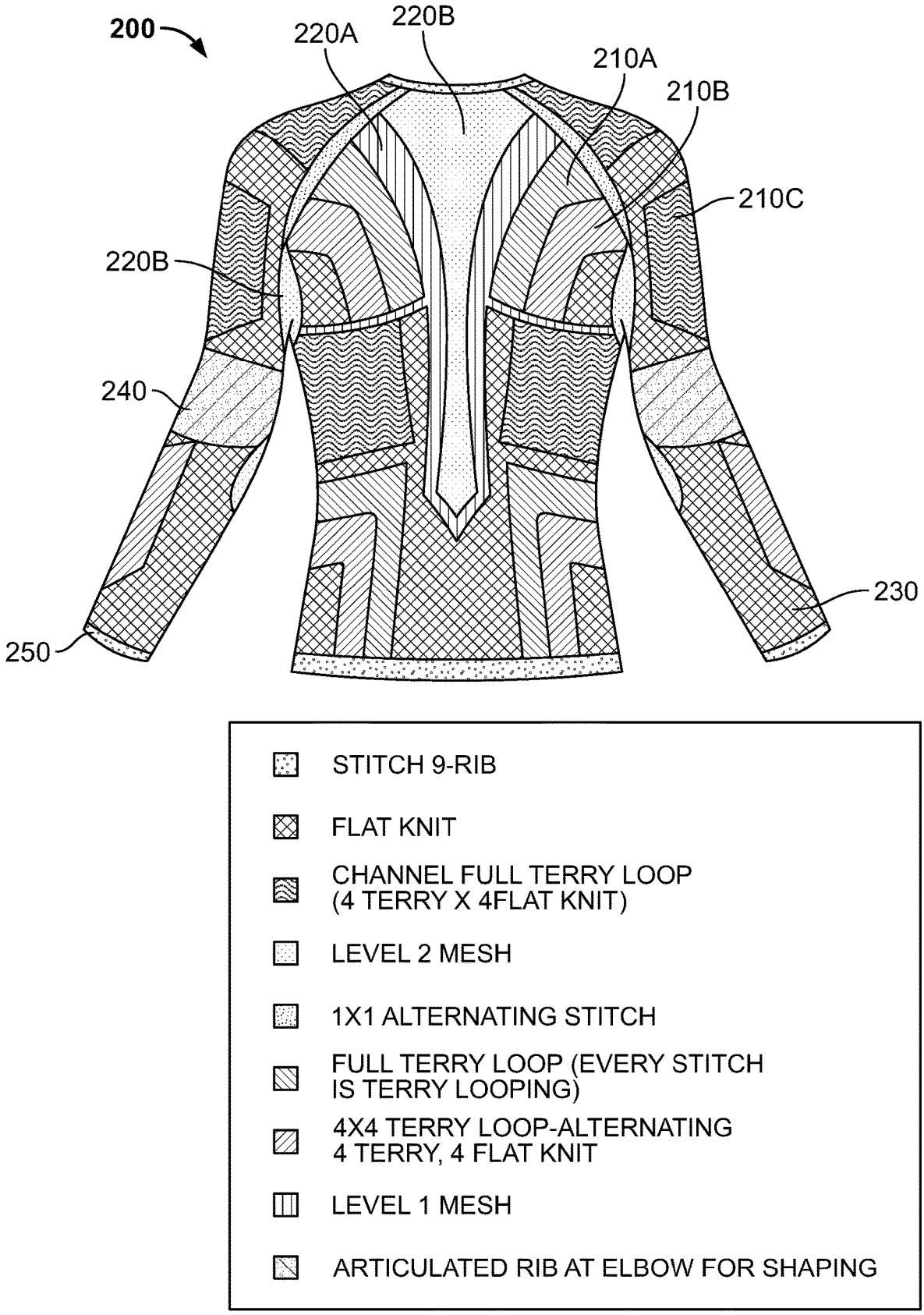
FIG. 2B is a schematic illustration of a back portion of the garment of FIG. 2A.

While garment 100 is illustrated as having only one type of cushioning zones 110 and one type of mesh zone 120, it should be understood that different "levels" or intensities of these types of zones may be provided. For example, FIGS. 2A-2B illustrate front and rear views, respectively, of a garment 200 according to another aspect of the disclosure. Garment 200 may take the form of a heavy weight top designed to meet the particular heating and ventilation needs for a male body, although it should be understood that garment 200 need not be limited to use by males. Similar to garment 100, garment 200 may include cushioning zones, mesh zones, and jersey zones. However, as shown in FIGS. 2A-2B and the corresponding legend provided therewith, garment may include multiple levels of mesh zones, including first level mesh zones 220*a* and second level mesh zones 220*b*. First level mesh zone 220*a* may include mesh knitting that provides relatively large openings compared to the mesh knitting of second level mesh zone 220*b*, so that the first level mesh zones provide for greater ventilation than the second level mesh zones, while the second level mesh zones provide for greater ventilation than the remaining zones (excluding the first level mesh zone) described herein. As with garment 100, mesh zones 220*a*, 220*b* may be positioned on garment 200 so that, when worn, the mesh zones are positioned adjacent areas of the body that perspire most, or that otherwise are perceived by the user to need the greatest ventilation, such as in the armpit and neck regions. Similarly, garment 200 may include various levels of cushioning zones, including first cushioning zones 210*a*, second cushioning zones 210*b*, and third cushioning zones 210*c*. First cushioning zones 210*a* may include full terry loop knitting in which every stitch is terry looping, and this first cushioning zone may provide the greatest amount of warmth. Second cushioning zones 210*b* may include knitting that includes knitting sequences of four terry loops followed by four flat knits. The term flat knits as used herein is interchangeable with jersey knitting. This 4×4 terry looping may be provided in a checkerboard-type of pattern, providing less overall warmth compared to the full terry looping. Third cushioning zones 210*c* may include knitting that includes alternating sequences of four full channels or rows of terry loop and four full rows of flat knitting. In other words, third cushioning zones 210*c* may provide terry looping in "channels" or "columns" adjacent other channels or columns of flat knitting, which may provide both warmth and breathability, although less warmth than full terry looping. Much of the remaining portions of garment 200 may include jersey zones 230 having flat/jersey knitting. As with garment 100, the jersey zones 230 may provide an intermediate level of warmth and ventilation compared to the various mesh zones 220*a-b* and cushioning zones 210*a-c*. Also additional zones, such as articulated rib zones 240 at the elbows and rib zones 250 at the cuffs, collar and/or hem line may be provided with garment 200.

The same or similar concepts regarding the seamless transitions between the various zones as described above in connection with FIGS. 1A-C may apply with equal force to garment 200 of FIGS. 2A-2B. In addition, it should be understood that the transition between zones of the same type (e.g. first level mesh zone 220*a* and second level mesh zone 220*b*) may be seamless, in addition to the transition between zones of different types (e.g. a first cushioning zone 210*a* and a first level mesh zone 220*a*).

Figure 3A:
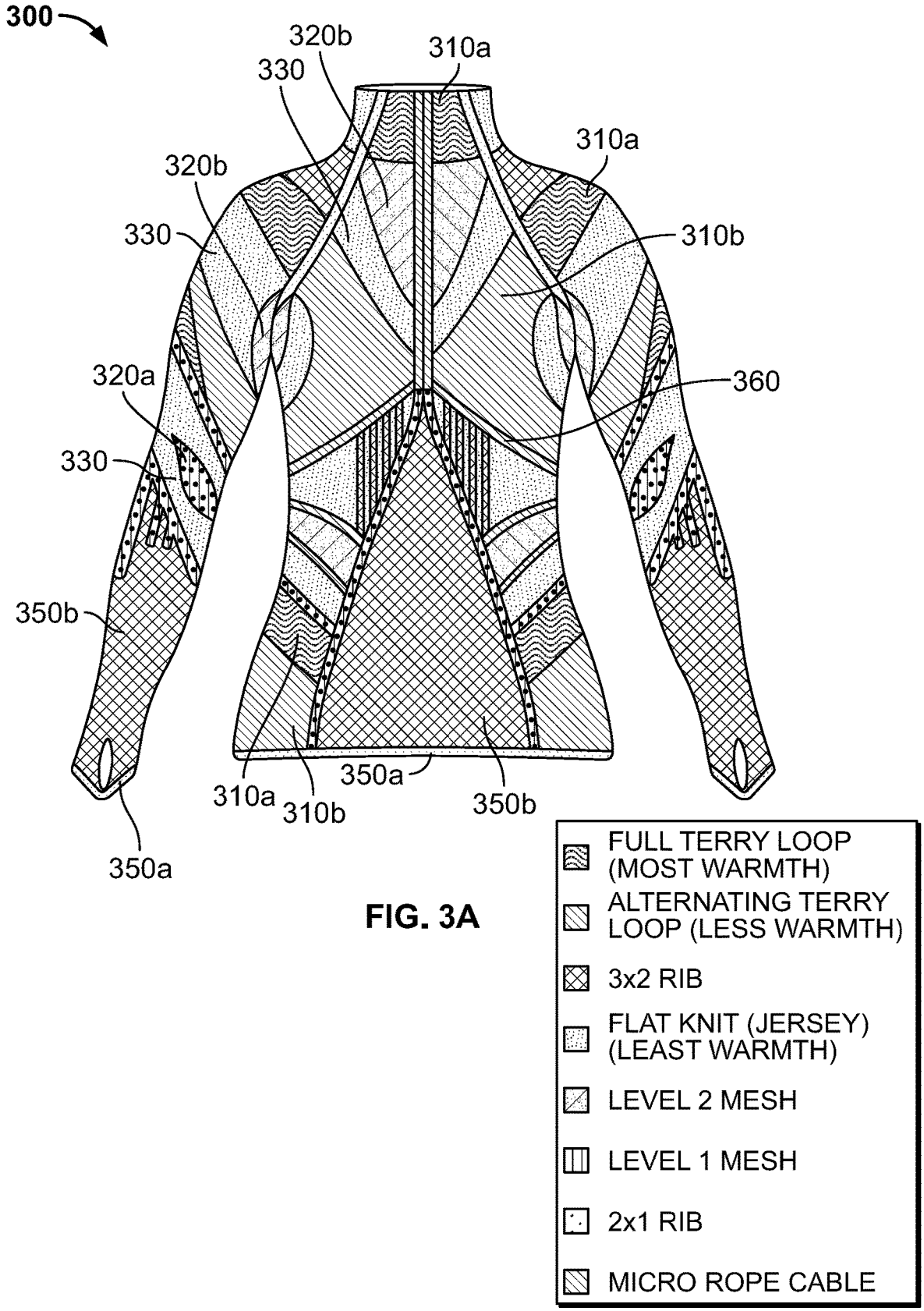
FIGS. 3A-B are schematic illustrations of a front portion of a garment according to a further aspect of the disclosure.
Figure 3B:
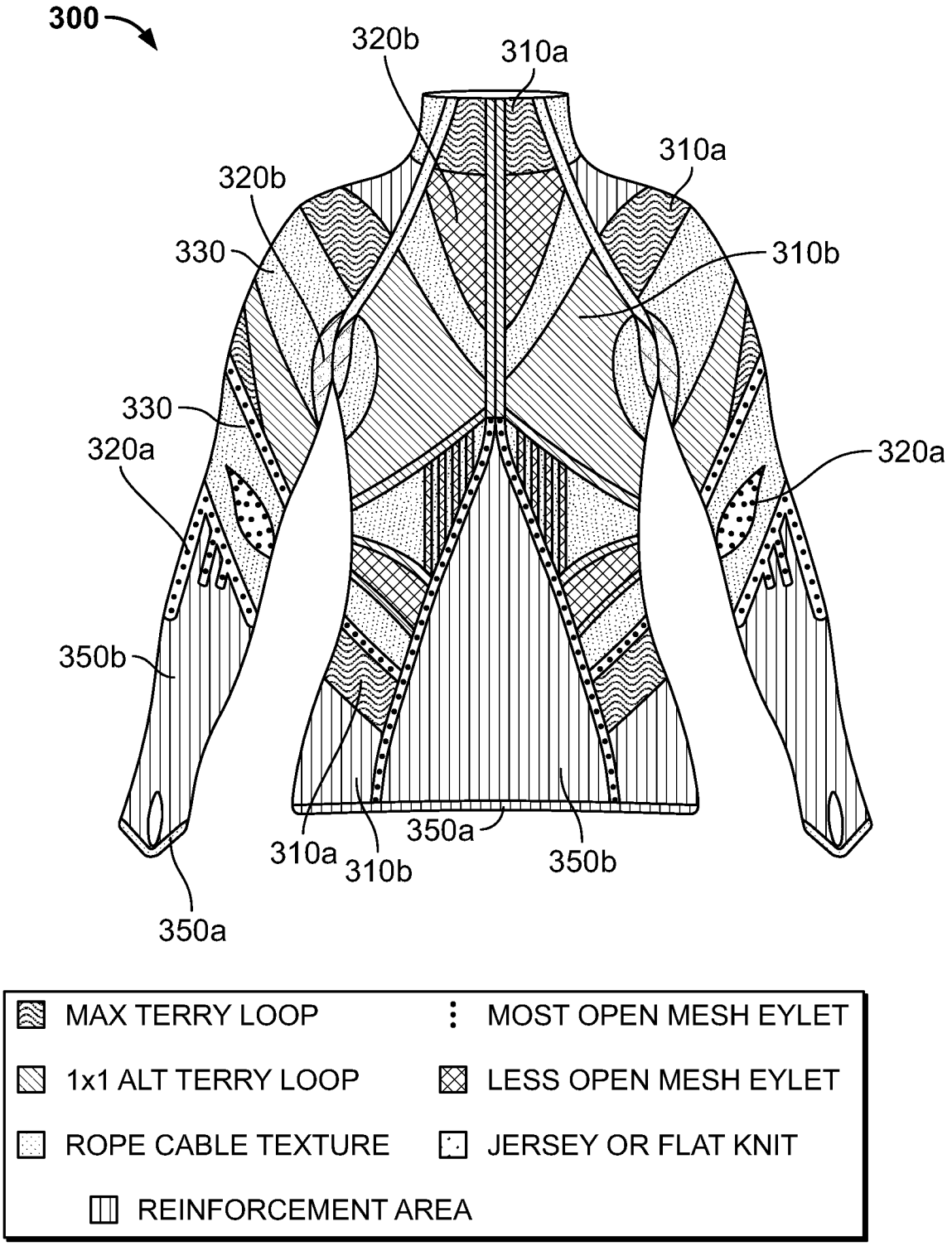
Figure 3C:
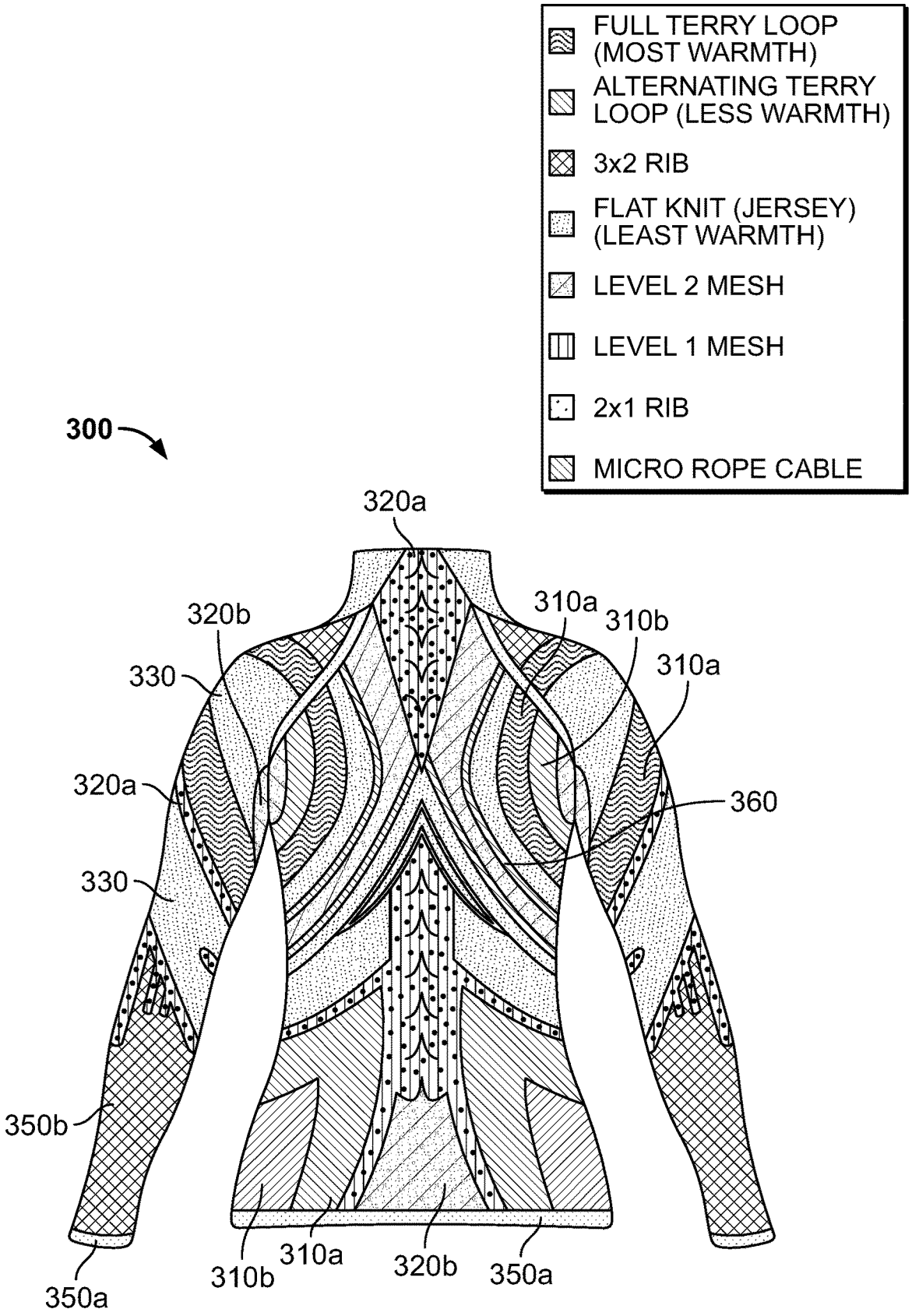
FIGS. 3C-D are schematic illustrations of a back portion of the garment of FIGS. 3A-B.
Figure 3D:
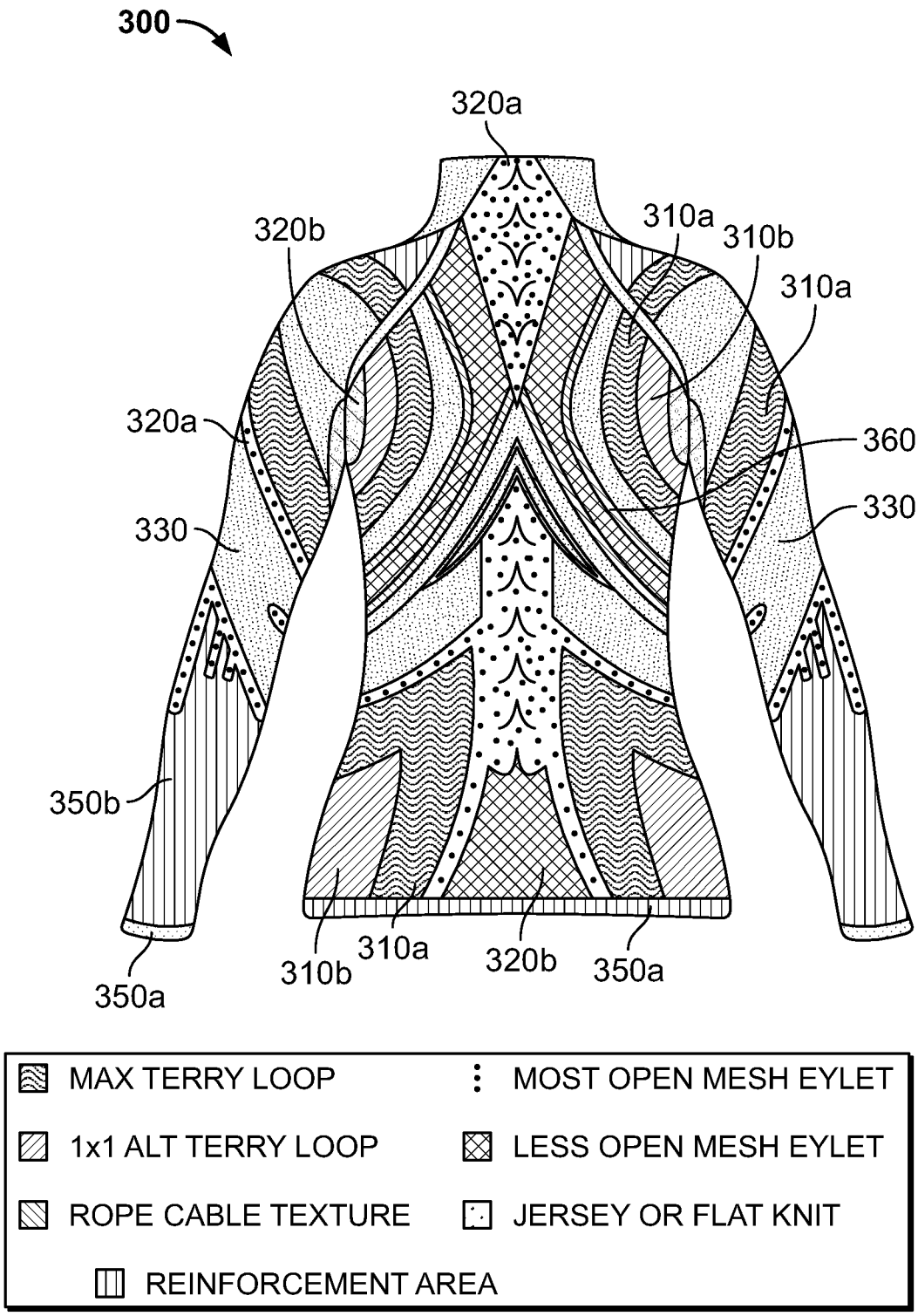
Figure 3E:
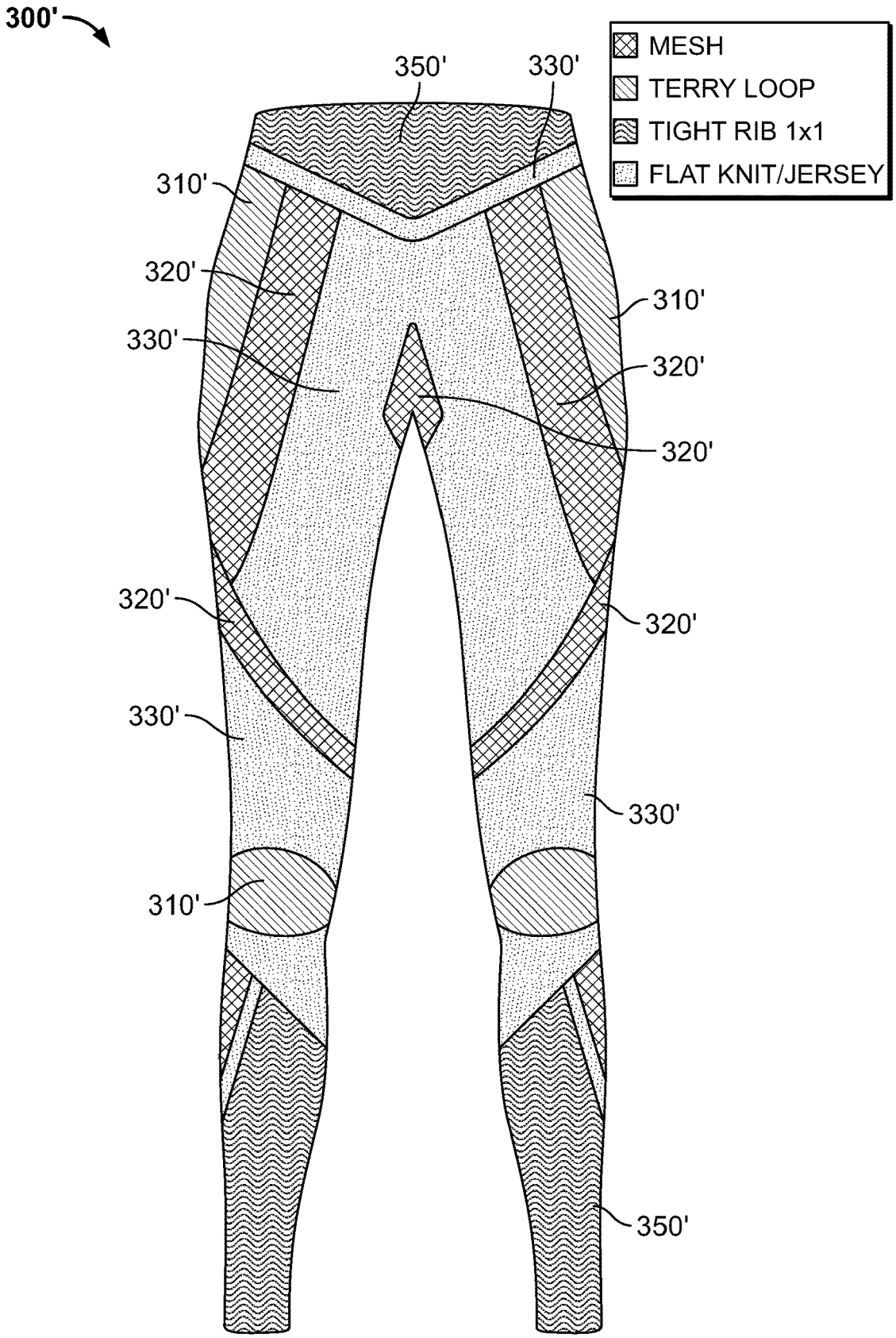
FIG. 3E is a schematic illustration of a front portion of a garment that may be paired with the garment of FIGS. 3A-B.

FIGS. 3A-3D illustrate front and rear views of a garment 300 according to another aspect of the disclosure. FIGS. 3A-B illustrate front views of garment 300, providing different legends to highlight certain zone of the garment, while FIGS. 3C-D illustrate rear views of the garment with different legends. Garment 300 may take the form of a top baselayer designed to meet the particular heating and ventilation needs for a female body, although it should be understood that garment 300 need not be limited to use by females. Similar to garment 200, garment 300 includes multiple levels of mesh and cushioning zones. For example, garment 300 may include first level mesh zones 320*a* and second level mesh zones 320*b*. As with garment 200, first level mesh zones 320*a* may include mesh knitting that provides relatively large openings compared to the mesh knitting of second level mesh zones 320*b*, so that the first level mesh zones provide for greater ventilation than the second level mesh zones, while the second level mesh zones provide for greater ventilation than the remaining zones (excluding the first level mesh zone) described herein. In FIGS. 3B and 3D-E, the first level mesh zones 320*a* correspond to the legend item for the "most open mesh eyelet" designations, while the second level mesh zones 320*b* correspond to the legend item for the "less open mesh eyelet" designations. Similar to other garments described herein, mesh zones 320*a*, 320*b* may be positioned on garment 300 so that, when worn, the mesh zones are positioned adjacent areas of the body that perspire most, or that otherwise are perceived by the user to need the greatest ventilation, such as in the armpit, neck, and lower back regions.

Garment 300 may also include various levels of cushioning zones, including first cushioning zones 310*a* and second cushioning zones 310*b*. First cushioning zones 310*a* may include full terry loop knitting in which every stitch is terry looping, and this first cushioning zone may provide the greatest amount of warmth. In FIGS. 3B and 3D-E, the first cushioning zones 310*a* having full terry looping correspond to the legend item for "max terry loop." Second cushioning zones 310*b* may include knitting that includes knitting having terry loops that alternate with flat or jersey knits, such as a 1×1 alternation between the two stitch types. In FIGS. 3B and 3D-E, the second cushioning zones 310*b* having alternating terry looping correspond to the legend item for "1×1 alt terry loop," and second cushioning zones 310*b* may provide for less warmth than the first cushioning zones 310*a*, but more warmth than the remaining zones of garment 300 (excluding first cushioning zones 310*a*).

Much of the remaining portions of garment 300 may include jersey zones 330 having flat/jersey knitting. As with other garments described herein, the jersey zones 330 may provide an intermediate level of warmth and ventilation compared to the various mesh zones 320*a-b* and cushioning zones 310*a-b*. Also additional zones may be provided as desired. Garment 300, for example, includes first rib zones 350*a* that include 2×1 rib knitting and second rib zones 350*b* having 3×2 rib knitting. Garment 300 may also include additional features, such as cable rope texturing 360, if desired.

As with the other garments described herein, elements of garment 300 may be formed with at least the cushioning zones 310*a-b*, mesh zones 320*a-b*, and jersey zones 330 in a seamless fashion, without needing to separately stitch together panels having the individual knit or stitch types.

Garments 100, 200, and 300 described herein may all include terry looping zones, jersey zones, and mesh zones within a single element of the garment that are created using continuous knitting, or in other words with seamless transitions between the three types of zones in the particular element. However, it should be understood that the various particular examples of stitches used in these three zones, as well as other types of knitting mentioned herein such as rib knitting, may also be included with seamless transitions between the terry loop, jersey, and/or mesh zones. When creating garments 100, 200, and/or 300, the garment may include seams only at the point of attachment of the different elements of the garment, such as the connection of one edge of a sleeve to itself, a front portion of the torso to a rear portion of the torso, and the attachment of the sleeves to the torso.

Figure 3F:
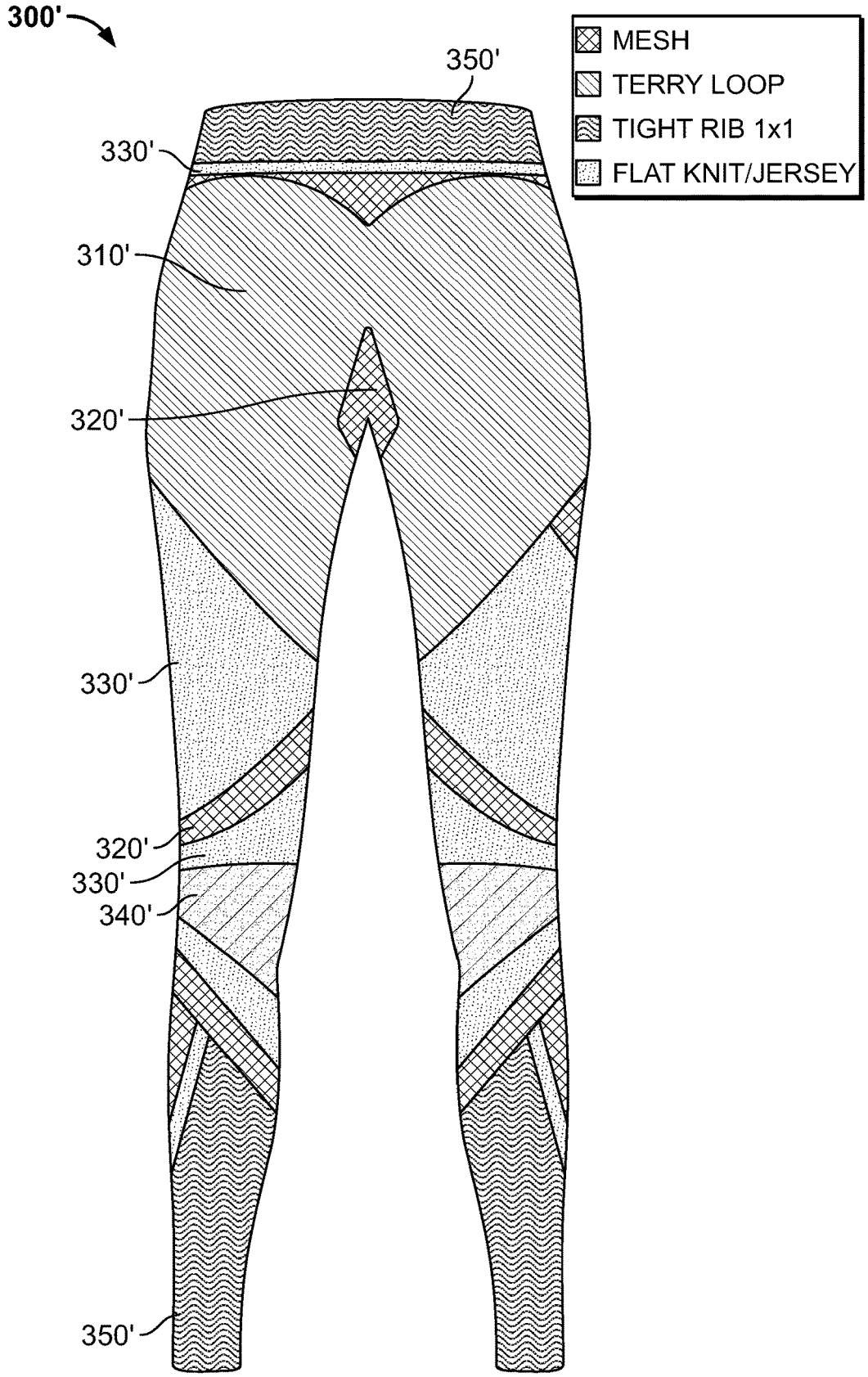
FIG. 3F is a schematic illustration of a rear portion of the garment of FIG. 3E.

Further, it should be understood that, although the garments described herein are generally in the form of tops or shirts, the same concepts may be applied to other types of garments such as pants. For example, FIGS. 3E-F illustrate a garment 300' in the form of tights or pants that may be paired with garment 300, although it should be understood that garment 300' is capable of use regardless of being paired with any other garment.

Garment 300', similar to other garments described herein, may include cushioning zones 310', mesh zones 320', jersey zones 330', articulated rib zones 340' and rib zones 350' that may generally serve the same purpose as the corresponding zones described above. Although the cushioning zones 310' and mesh zones 320' are not illustrated as including separate types of cushioning, such as full terry loop zones compared to channel terry zones, or relatively large mesh zones compared to relatively small mesh zones, it should be understood that any of the variations of individual zone types may be suitable for use in garment 300'. As should be understood from FIGS. 3E-F and from the description above, the positioning of the various zones may be provided based on the needs (or perceived needs) of the user, such as additional warmth in the buttocks and rear thigh areas, and increased ventilation or breathability in the groin area. As with the garments and elements thereof described above, the elements forming garment 300' may include the various described knitting zones as continuous knitting without requiring the different zones to be cut and sewn together, providing the same or similar benefits as described above for garments 100, 200, and 300.

Although the invention herein has been described with reference to particular embodiments, it is to be understood that these embodiments are merely illustrative of the principles and applications of the present invention. For example, although the disclosure herein is generally directed to tops and bottoms, or knit fabrics for use therewith, the concepts may be applied to various other types of garments and apparel other than those specifically described and/or shown herein. For example, the seamless knitting described above may be used in garments such as hats, gloves, balaclavas, footwear, neck gaiters, face masks, and the like. It is therefore to be understood that numerous modifications may be made to the illustrative embodiments and that other arrangements may be devised without departing from the spirit and scope of the present invention as defined by the appended claims.

The invention claimed is:

1. A knitted element comprising:

a first zone that includes terry loop knitting;

a second zone that includes mesh knitting;

a third zone that includes jersey knitting; and at least one seamless transition between the first zone and the second zone, or between the first zone and the third zone, so that terry loop knitting is continuous with either the mesh knitting or the jersey knitting, wherein terry loops of the terry loop knitting are knitted on an interior of the knitted element and are secured to a ground or face yarn of the knitted element, thereby securing the terry loops to the interior to prevent the terry loops from pulling out, wherein the knitted element is a flat element obtainable by flat bed knitting.

2. The knitted element of claim 1, wherein the first zone, the second zone, and the third zone each include wool knitting.

3. The knitted element of claim 2, wherein the wool knitting includes wool wrapped around a nylon core.

4. The knitted element of claim 1, further comprising:

a fourth zone that includes mesh knitting, the mesh knitting of the second zone defining openings that are larger than openings defined by the mesh knitting of the fourth zone.

5. The knitted element of claim 1, wherein the terry loop knitting of the first zone includes full terry looping such that each stitch in the first zone includes terry looping.

6. The knitted element of claim 1, wherein the terry loop knitting of the first zone includes a stitch pattern that alternates between terry looping and jersey knits.

7. The knitted element of claim 1, wherein the at least one seamless transition includes a first seamless transition between the first zone and the second zone, and a second seamless transition between the first zone and the third zone, so that the knitted element includes terry loop knitting that is continuous with both the mesh knitting and the jersey knitting.

8. A garment comprising:

a first knitted element according to claim 1.

9. The garment of claim 8, wherein the first knitted element is a sleeve of a top.

10. The garment of claim 9, wherein the second zone of the sleeve is positioned adjacent at least one of an interior elbow area of the sleeve and an armpit area of the sleeve.

11. The garment of claim 8, wherein the first knitted element is a front torso of a top.

12. The garment of claim 11, wherein the first zone is positioned adjacent at least one of a shoulder area and a chest area of the front torso.

13. A garment comprising:

a plurality of the knitted elements of claim 1.

14. The garment of claim 13, wherein the plurality of knitted elements includes a sleeve element, a front torso element, and a back torso element.

* * * * *